United States Patent [19]

Andersson

[11] 4,265,096

[45] May 5, 1981

[54] FREEZING PLANT FOR FOOD PRODUCTS

[75] Inventor: Gustaf A. Andersson, Viken, Sweden

[73] Assignee: Frigoscandia Contracting AB, Sweden

[21] Appl. No.: 70,468

[22] Filed: Aug. 28, 1979

[30] Foreign Application Priority Data

Sep. 6, 1978 [SE] Sweden ..... 7809386

[51] Int. Cl.[3] ..... F25D 25/04

[52] U.S. Cl. ..... 62/380; 62/65

[58] Field of Search ..... 62/63, 65, 266, 380

[56] References Cited

U.S. PATENT DOCUMENTS

| | | | |
|---|---|---|---|
| 2,015,167 | 9/1935 | Varney | 62/63 |
| 2,059,970 | 11/1936 | Robillard | 62/63 |
| 2,974,497 | 3/1961 | Carpenter et al. | 62/63 |
| 3,238,736 | 3/1966 | Macintosh | 62/63 |
| 3,300,993 | 1/1967 | Schlemmer | 62/63 |
| 3,413,818 | 12/1968 | Pelmulder | 62/63 |
| 3,800,689 | 4/1974 | Brown | 126/299 D |
| 3,805,538 | 4/1974 | Fritch, Jr. et al. | 62/63 |
| 3,864,931 | 2/1975 | Guttinger | 62/63 |

*Primary Examiner*—Ronald C. Capossela
*Attorney, Agent, or Firm*—Karl W. Flocks

[57] ABSTRACT

Arrangement in a freezing plant, comprising a combination of a conventional freezer and a precool unit. The arrangement is connected between the freezer and the precool unit in such a way that the amount of air in the freezing plant is maintained substantially constant without any reaction with the ambient atmosphere.

5 Claims, 2 Drawing Figures

FREEZING PLANT FOR FOOD PRODUCTS

Figure 2:
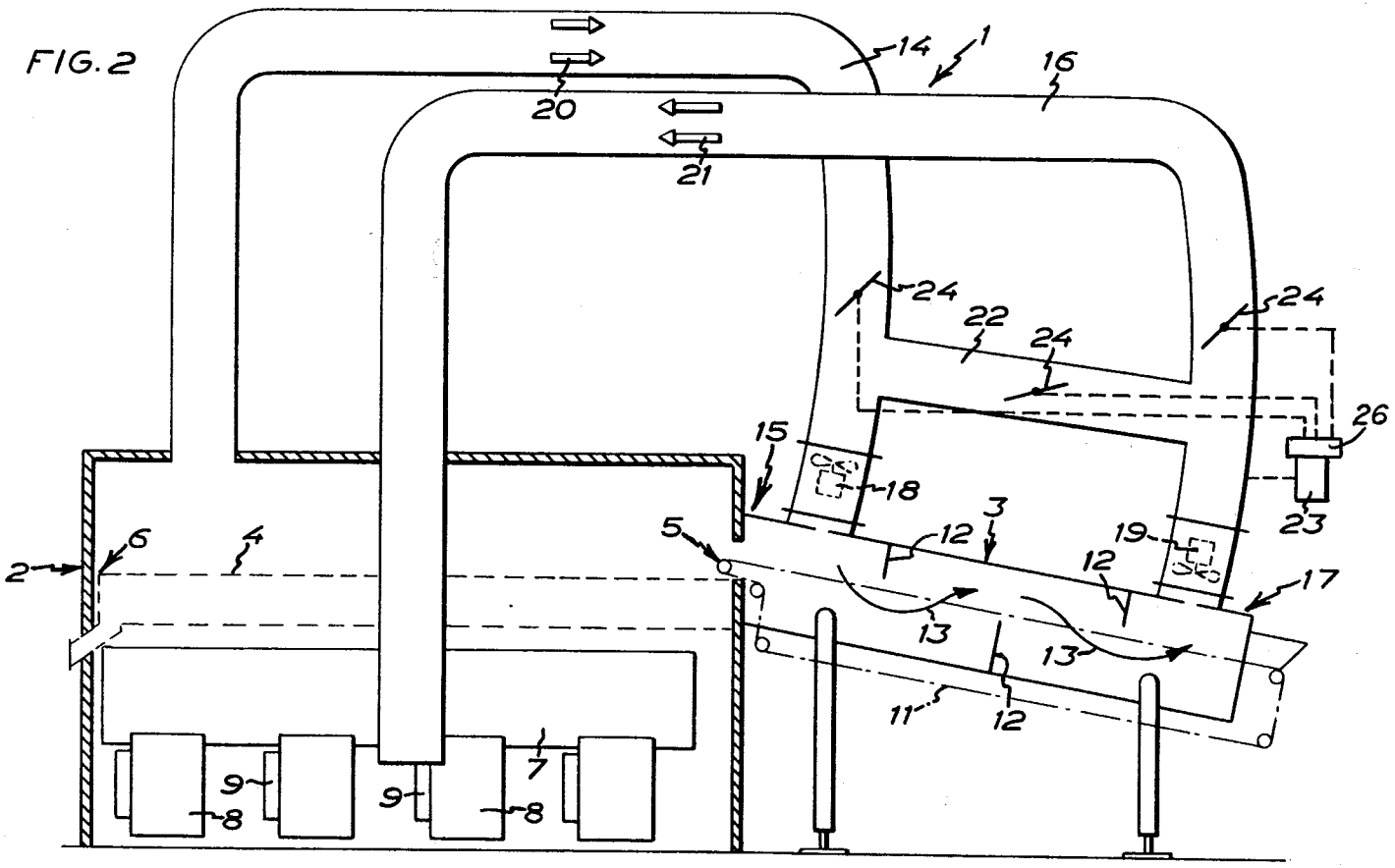

This invention relates to an arrangement in a freezing plant for food products having a preferably low bulk weight and/or long holding time as compared with, for example, peas, said plant including a freezer and, coupled to the infeed end thereof, a precool unit to the outfeed end of which there is connected an inlet pipe through which cooling air is caused to flow through the precool unit in a direction opposite to the feed direction of the product and out through an outlet pipe.

The freezers known under the trade-name FLoFREEZE® are very fit for use in freezing the above-mentioned products. However, at the infeed end of the freezer clogging of the cooling-coil batteries often arises due to freezing because the warm, unfrozen products yield moisture when entering the freezer, which results in frost formation on the cooling-coil batteries. After some time the flow of air is hindered and so is consequently the function of the freezer. As appears from what is said above this frost formation is concentrated to the infeed section at the cooling-coil batteries. When the cooling-coil batteries are frosted up at the infeed section, breakdowns occur in the form of formation of lumps of the product due to reduced current of air and reduced capacity during freezing. In this connection the production must be stopped and defrosting of the cooling-coil batteries must be effected. This implies lost time of production although the major part of the cooling-coil batteries is free from frost.

To improve the efficiency of a freezer of the type mentioned above a precool unit may be installed at the infeed end thereof. A cold product will thus be fed into the freezer and this will substantially prevent frosting of the infeed end of the freezer. In prior art freezing plants provided with such precool units, cold air is led from the freezer to the outfeed end of the precool unit and then in a direction opposite to the feed direction of the product and out of the plant.

Such an arrangement often results in partial vacuum in the freezing plant so that hot air is sucked into it, especially at the outfeed end of the freezer, whereby the risk of clogging due to frost formation still exists.

It is consequently an object of the present invention to provide in a freezing plant with precool unit an arrangement by means of which a balance of air is maintained in the freezing plant and which eliminates the above-mentioned disadvantages.

Another object of the present invention is to provide the freezing plant with an arrangement which is cheap to install and reliable in construction and function.

Normally a freezing equipment is dimensioned so that there is a balance between the product-carrying surface and the cooling-coil battery surface/cooling effect. Assume that the freezing equipment is dimensioned for peas but it is intended to freeze strawberries, which requires a longer time of freezing, then the product-carrying surface will be limitative so that the installed cooling effect cannot be utilized. The freezing capacity also decreases if the product is warm and moist since, as mentioned above, the cooling-coil battery will be frosted up too fast at the infeed end.

Still another object of the present invention is therefore to provide a freezing plant with an arrangement by means of which the product infeed temperature is decreased and, consequently, the freezing capacity is increased and an air balance is maintained in the freezing plant such that the frost will be evenly distributed over the entire cooling-coil battery.

These objects are achieved according to the present invention in that the inlet pipe is connected to the freezer and that the outlet pipe is connected to the freezer in such a way that the air returning thereto will be evenly spread over the cooling elements of the freezer, whereby the amount of air in the freezing plant is maintained substantially constant without any reaction with the ambient atmosphere.

Other objects of the invention and further features and advantages thereof will be apparent from the following detailed description and claims to be read in conjunction with the accompanying drawings, wherein:

FIG. 1 is a partly sectional side view of a first embodiment of an arrangement according to the invention; and FIG. 2 is a view similar to that of FIG. 1, showing a second embodiment of said arrangement.

As shown in the drawings, the freezing plant 1 includes a freezer 2 and a precool unit 3.

A transport means 4 for the product to be frozen extends from the infeed end 5 of the freezer to the outfeed end 6 thereof. The product has preferably a low bulk weight and/or long holding time as compared with peas, for example. The freezer is preferably of the type available under the tradename FLoFREEZE® and has one or more cooling-coil batteries 7 arranged under the transport means 4 which, in this case, is a perforated tray, in which the air current from fans 8 beneath the cooling-coil batteries 7 carries the product forwards through the freezer. During operation the fans 8 in the freezer cause air to pass through the freezer in a helical path from below through the cooling-coil batteries 7, the transport means 4 and the product and then back to the suction sides 9 of the fans.

The precool unit is coupled on to the infeed end 5 of the freezer 2 and has a conveyor belt 11 adapted to carry the product to the transport means 4 of the freezer. A number of baffles 12 are arranged in zigzag longitudinally of the precool unit and these cause the air fed through the precool unit to pass the product several times (see arrows 13).

An inlet or first pipe 14 for cooling air to the precool unit is connected between the outfeed end 15 of the precool unit and the outfeed end 6 of the freezer. An outlet or second pipe 16 for the air returning to the freezer 2 is connected between the infeed end 17 of the precool unit and to the central part of the freezer at the suction sides 9 of the fans 8.

Two fans 18 and 19 are arranged in respectively the inlet pipe 14 and the outlet pipe 16 and cause the air to flow in the direction of the arrows 20 and 21 respectively. The rates of these fans 18 and 19 are adjusted to each other to maintain an air balance in the freezing plant such that no air is sucked in or blown out at the outfeed end 6 of the freezer or the infeed end 17 of the precool unit. One must take into special account that part of the air supplied to the precool unit via the inlet pipe 14 which passes back to the freezer 2 via the opening between the precool unit 3 and the freezer 2.

By means of the arrangement of the present invention the product will have a lower temperature and less moisture, which gives a lower load on the cooling-coil batteries 7 at the infeed end 5.

The cooling air for the precool unit 3 is taken from the outfeed end 6 of the freezer 2, where the air has a low temperature. The moist air heated up by the product is fed back to the centre of the freezer where it is distributed to several fans 8 due to the fact that the air through these fans flows in helical paths within the freezer.

A further development of the freezer in accordance with the present invention is shown in FIG. 2, wherein details similar to the details of FIG. 1 have the same reference numerals. In this preferred embodiment a bypass line 22 has been connected between the inlet pipe 14 and the outlet pipe 16 according to FIG. 2. With the bypass line the air quantity in the precool unit can be kept constant. Regulation of the temperature of the cooling air is obtained by supplying cold air from the inlet pipe 14. A temperature measuring instrument 23 senses the temperature of the air in the outlet pipe 16 and controls throttles 24 fitted in the pipes by means of a transmitter element 26, which may be electrical, pneumatic, or other known means communicating with motor means for turning dampers 24 through electrical conductors, fluid conduits, or the like represented schematically in dotted lines.

The arrangement according to the present invention makes it possible to obtain a more even load on the cooling-coil batteries and, thus, a more even distribution of the frost coating. The service periods between the defrosting operations will therefore be longer although the capacity is the same.

By the incorporation of the arrangement of this invention with the freezing plant it is calculated that the freezing plant will also give a higher capacity for products with low bulk weight and/or long holding time due to a better utilization of the cooling-coil batteries.

The invention is of course not limited to a freezer of the type FLoFREEZE ®, but it may also be used with other prior art freezers.

The invention is not restricted to the embodiments described above but can be modified within the scope of the appendant claims.

What I claim and desire to secure by Letters Patent is:

1. An arrangement in a freezing unit for food products having a preferably low bulk weight and/or long holding time as compared with, for example, peas, said plant comprising in combination:

(a) a freezer having an infeed end, an outfeed end, and cooling elements between said infeed end and said outfeed end;

(b) a precool unit having an infeed end and an outfeed end, said precool unit being coupled at the outfeed end thereof to said freezer at the infeed end of said freezer;

(c) means for circulating air from said freezer to said precool unit and back to said freezer so that air returned to said freezer will be evenly spread over said cooling elements and whereby the amount of air in said freezing plant is maintained substantially constant without any reaction with ambient atmosphere wherein said air circulating means includes a first pipe connecting said freezer and said precool unit adjacent said outfeed end of said precool unit for cooling air to flow from said freezer to said precool unit and through said precool unit in a direction opposite to the feed direction of the product, and a second pipe connecting said precool unit to said freezer for air to return from said precool unit back to said freezer.

2. Arrangement as claimed in claim 1, wherein a bypass line (22) is connected between the first and second pipes (14, 16) for ensuring that the air quantity in the precool unit (3) is kept constant.

3. Arrangement as claimed in claim 2, wherein throttle members are provided in said first and second pipes and wherein a temperature measuring instrument (23) is provided in said second pipe to sense the temperature of the air in the second pipe (16) and to control said throttle members (24) in the first and second pipes (14, 16) and the bypass line (22).

4. Arrangement as claimed in any of claims 2, 3 or 1 wherein fans (18, 19) are arranged in respectively the first pipe (14) and second pipe (16), the rates of these fans being chosen so as to maintain an air balance in the freezing plant such that no air is sucked in or blown out at the infeed end (17) or outfeed end (6) of the freezing plant.

5. Apparatus as claimed in claim 4, wherein the outlet of the second pipe (16) is placed inside and at the centre of the freezer (2).

* * * * *